US007233100B2

(12) United States Patent
Hea

(10) Patent No.: US 7,233,100 B2
(45) Date of Patent: Jun. 19, 2007

(54) LIGHTING APPARATUS USING MICROWAVE

(75) Inventor: Hyoun-Soo Hea, Gyeongsangbuk-do (KR)

(73) Assignee: LG Electronics Inc. (KR)

( * ) Notice: Subject to any disclaimer, the term of this patent is extended or adjusted under 35 U.S.C. 154(b) by 727 days.

(21) Appl. No.: 10/122,874

(22) Filed: Apr. 12, 2002

(65) Prior Publication Data

US 2003/0098639 A1 May 29, 2003

(30) Foreign Application Priority Data

Nov. 23, 2001 (KR) ..... 2001-73469

(51) Int. Cl.

| | |
|---|---|
| ***H01J 5/16*** | (2006.01) |
| ***H01J 61/40*** | (2006.01) |
| ***H01K 1/26*** | (2006.01) |
| ***H01K 1/30*** | (2006.01) |

(52) U.S. Cl. ..... 313/113; 313/114; 313/231.31; 313/231.61; 362/341

(58) Field of Classification Search ..... 313/113, 313/114, 231.31, 231.41, 231.61; 315/39; 362/341, 343, 396, 293, 583, 296
See application file for complete search history.

(56) References Cited

U.S. PATENT DOCUMENTS

| | | | | | |
|---|---|---|---|---|---|
| 2,974,243 | A | | 3/1961 | Marrison | 313/46 |
| 5,334,913 | A | * | 8/1994 | Ury et al. | 315/248 |
| 5,811,936 | A | * | 9/1998 | Turner et al. | 315/39 |
| 5,841,233 | A | * | 11/1998 | Ury et al. | 315/39 |
| 5,866,990 | A | * | 2/1999 | Ury et al. | 315/248 |
| 6,486,594 | B1 | | 11/2002 | Kang | 313/231.31 |
| 6,734,638 | B2 | * | 5/2004 | Kang et al. | 315/248 |

FOREIGN PATENT DOCUMENTS

| | | |
|---|---|---|
| CN | 1298198 | 6/2001 |
| EP | 1 124 089 A2 | 2/2001 |
| WO | 97/27617 | 7/1997 |
| WO | 98/28780 | 7/1998 |

OTHER PUBLICATIONS

Abstract of Japanese Publication No. JP62105355, vol. 011, No. 312 (E–548), Oct. 12, 1987.
Office Action issued by Chinese Patent Office in connection with corresponding Chinese application No. 02119194.8 dated Oct. 14, 2004.
English translation of Chinese Office Action issued against 02119194.8 on Oct. 14, 2004.

* cited by examiner

*Primary Examiner*—Nimeshjumar D. Patel
*Assistant Examiner*—Kevin Quarterman
(74) *Attorney, Agent, or Firm*—Ostrolenk, Faber, Gerb & Soffen, LLP

(57) ABSTRACT

A lighting apparatus using microwave comprises: a waveguide for transmitting microwave generated in a magnetron; a mesh screen installed on an outlet portion of the waveguide for blocking a leakage of the microwave and passing light; a bulb located in the mesh screen for emitting light by the microwave; a dielectric mirror installed on the outlet portion of the waveguide for reflecting the light emitted in the bulb forward parallelly; and a reflector installed around the mesh screen for reflecting the light emitted in the bulb forward, and the reflector and the dielectric mirror are constructed so that the light generated in the bulb can be radiated as parallel ray, whereby loss of light can be minimized and lighting efficiency can be improved.

20 Claims, 4 Drawing Sheets

LIGHTING APPARATUS USING MICROWAVE

BACKGROUND OF THE INVENTION

1. Field of the Invention

The present invention relates to a lighting apparatus using microwave, and particularly, to a lighting apparatus using microwave including a dielectric mirror reflecting a light generated in a bulb forward.

2. Description of the Background Art

Generally, a lighting apparatus using microwave is an apparatus for emitting a visible ray or ultraviolet rays by radiating a microwave to an electrodeless plasma bulb, and it has longer life span than that of an incandescent lamp or of a fluorescent lamp and has superior lighting effect.

FIG. 1 is a longitudinal cross-sectional view showing an example of a lighting apparatus using microwave according to the conventional art.

As shown therein, the lighting apparatus using the microwave according to the conventional art comprises: a magnetron 2 installed inside a case 1 for generating microwave; a high voltage generator 3 for raising utility AC power into high voltage and providing the magnetron with the power; a waveguide 4 for transmitting the microwave generated in the magnetron 2; a mesh screen 6 installed on an outlet portion of the waveguide 4 for breaking a leakage of the microwave and passing the light; and a bulb 5 located in the mesh screen 6 for emitting light as a material filled in the bulb 5 becomes plasma by the microwave energy transmitted through the waveguide 4.

The lighting apparatus using the microwave includes a reflector 7 disposed in front of the case 1 which is a peripheral area of the mesh screen 6 for reflecting the light generated in the bulb 5 forward concentratively.

Also, a dielectric mirror 8 passing the microwave transmitted through the waveguide 4 and reflecting the light emitted from the bulb 5 forward is installed in an outlet portion 4*a* of the waveguide 4.

Herein, the reflector 7 is formed as a curved surface of parabola shape, however, the dielectric mirror 8 is formed as a plane having a hole 8*a* on a central part so as to penetrate a shaft portion 5*b* of the bulb 5.

On the other hand, a cooling fan assembly 9 for cooling down the magnetron 2 and the high voltage generator 3 is disposed on rear area of the case 1. In addition, unexplained reference numeral 9*a* represents a fan housing, 9*b* represents a blast fan, M1 represents a bulb motor, and M2 represents a fan motor.

An operation of the lighting apparatus using the microwave according to the conventional art will be described as follows.

When an operation signal is inputted to the high voltage generator 3, the high voltage generator 3 raises AC power and provides the magnetron 2 with the raised high voltage. And the magnetron 2 is oscillated by the high voltage and generates microwave of very high frequency. The generated microwave is radiated into the mesh screen 6 through the waveguide 4 to emit light having its own emission spectrum by discharging the material filled in the bulb 5. In addition, the light is reflected by the reflector 7 and by the dielectric mirror 8 forward.

However, according to the conventional lighting apparatus using the microwave described above, the light reflected by the reflector 7 is radiated as a straight light and concentrated, but the light reflected by the dielectric mirror 8 is dispersed to a plurality of directions according to incidence angles, as shown in FIG. 2. Therefore, some of the light emitted from the bulb 5 is reflected on the dielectric mirror 8 and lost, and thereby the lighting effect is lowered.

Also, the bulb 5 should be disposed on a focal point of the reflector 7 in order to generate straight line light most, however, the dielectric mirror 8 formed as a plane is installed nearly to the focal point. Therefore, it is difficult to dispose the bulb 5 exactly on the focal point of the reflector 7.

SUMMARY OF THE INVENTION

Therefore, an object of the present invention is to provide a lighting apparatus using microwave which is constructed so that light generated in a bulb can be radiated to be parallel, and therefore, a lighting efficiency is improved and loss of light is minimized.

Also, another object of the present invention is to provide a lighting apparatus using microwave in which a bulb can be disposed on a focal point of a reflector easily to make a positioning of the bulb be easier.

To achieve these and other advantages and in accordance with the purpose of the present invention, as embodied and broadly described herein, there is provided a lighting apparatus using microwave comprising: a waveguide for transmitting microwave generated in a magnetron; a mesh screen installed on an outlet portion of the waveguide for blocking a leakage of the microwave and passing light; a bulb installed in the mesh screen for emitting light by the microwave; a dielectric mirror installed on an outlet portion of the waveguide for passing the microwave and reflecting the light emitted from the bulb parallelly forward; and a reflector installed around the mesh screen for reflecting the light emitted from the bulb forward.

The dielectric mirror is formed as non-plane shape.

The above dielectric mirror is formed as a streamline cross section having a predetermined curvature.

The bulb is disposed on a focal point of the dielectric mirror.

The dielectric mirror is formed to have same curvature as that of the reflector.

The bulb is disposed on a focal point of a parabola made by the dielectric mirror and the reflector.

A bulb shaft which is connected to the bulb is passed through the outlet portion of the waveguide, and the dielectric mirror includes a hole so that the bulb shaft can be passed therethrough.

A mirror mounting portion which is protruded inward is formed on the outlet portion of the waveguide so as to install the dielectric mirror.

The mirror mounting portion is formed on an end portion of the waveguide.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
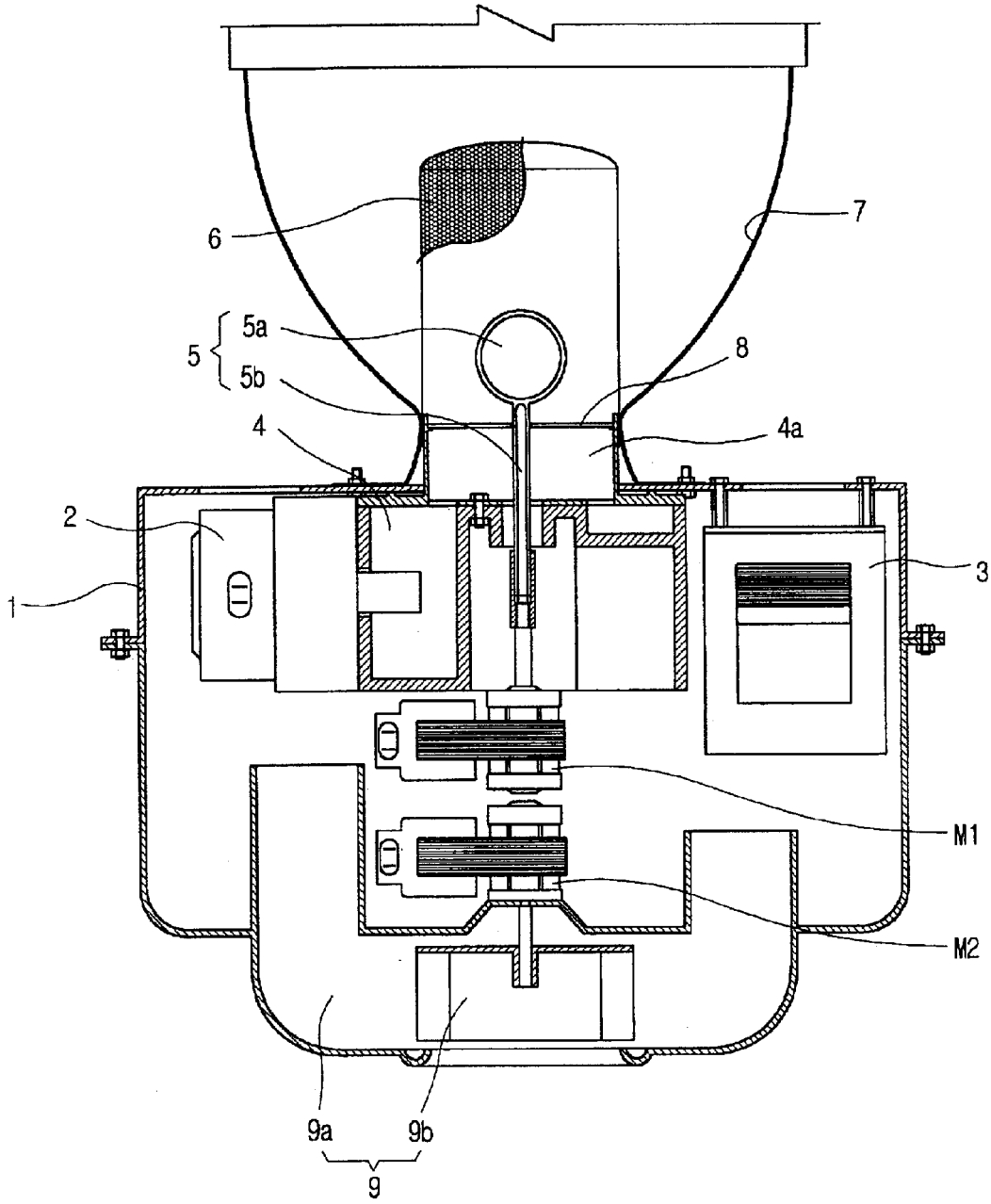
FIG. 1 CONVENTIONAL ART
FIG. 1 is a longitudinal cross-sectional view showing an example of a lighting apparatus using microwave according to the conventional art.
Figure 2:
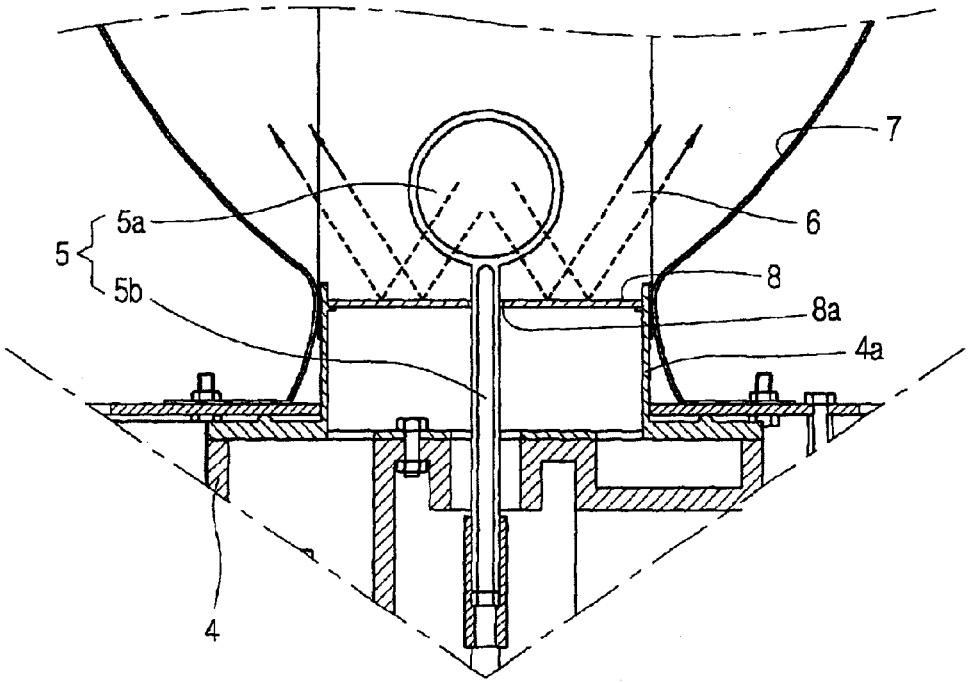
FIG. 2 CONVENTIONAL ART
FIG. 2 is a detailed view for describing a dielectric mirror shown in FIG. 1.

Reference will now be made in detail to the preferred embodiments of the present invention, examples of which are illustrated in the accompanying drawings.

For same parts as those of the conventional art, same reference numerals are used.

Figure 3:
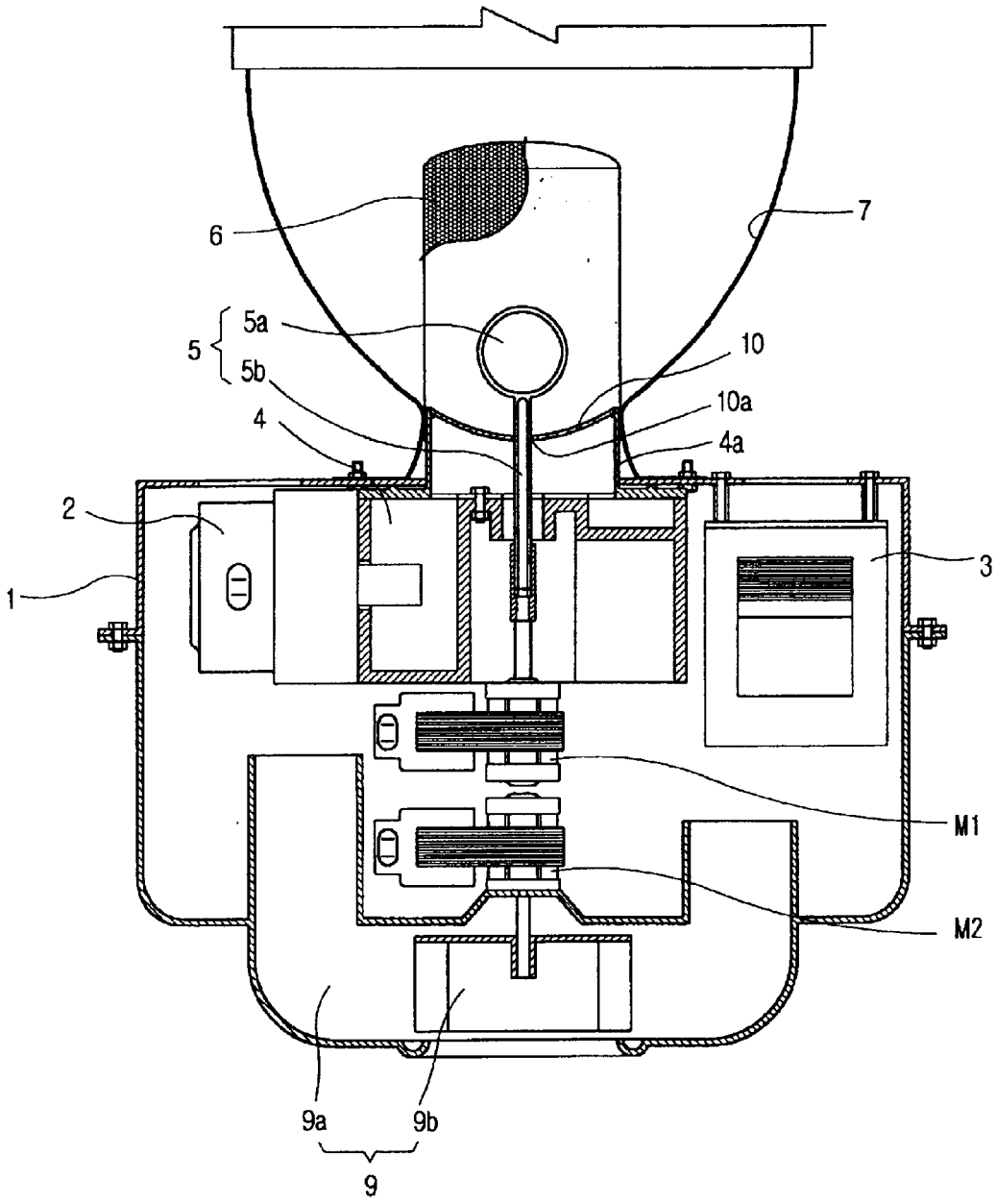
FIG. 3 is a longitudinal cross-sectional view showing a lighting apparatus using microwave according to the present invention.
Figure 4:
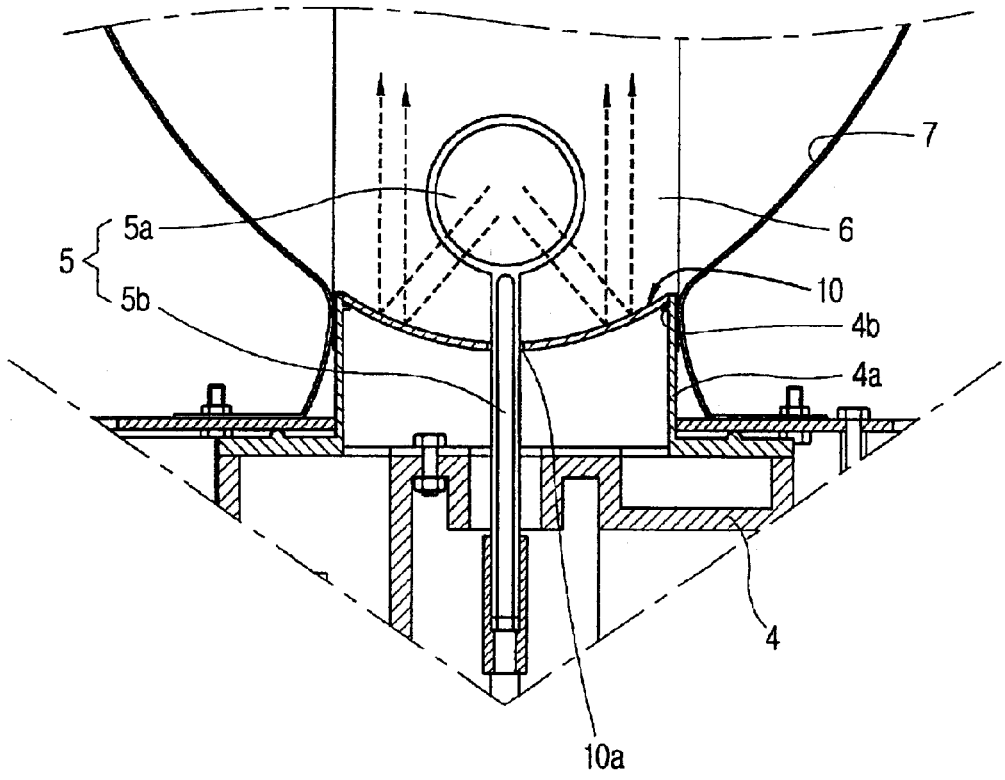
FIG. 4 is a detailed view showing principal parts shown in FIG. 3 for describing an operation of the dielectric mirror in FIG. 3.

FIG. 3 is a longitudinal cross-sectional view showing a lighting apparatus using microwave according to the present invention, and FIG. 4 is a detailed view for describing an operation of a dielectric mirror shown in FIG. 3.

As shown therein, the lighting apparatus using microwave according to the present invention comprises: a magnetron 2 mounted in a case 1 for generating microwave; a high voltage generator 3 for raising utility AC power to high voltage and providing the magnetron 2 with the high voltage; a waveguide 4 for transmitting the microwave generated in the magnetron 2; a mesh screen 6 covered on an outlet portion 4*a* of the waveguide 4 for blocking the microwave and passing the light; and a bulb 5 located in the mesh screen 6 for emitting light by making a material filled in the bulb 5*b* as plasma by the microwave energy transmitted through the waveguide 4.

Also, a reflector 7 for integrally reflecting the light generated in the bulb 5 forward is fixedly installed on the case 1 around the mesh screen 6. And a dielectric mirror 10 for passing the microwave and reflecting the light is mounted on an outlet portion of the waveguide 4 on rear part of the bulb 5.

Herein, the dielectric mirror 10 is formed to have streamlined cross section having same curvature as that of the reflector 7, which is a parabola mirror, and a through hole 10*a* is formed on a center part of the dielectric mirror 10 so that a shaft portion 5*b* of the bulb 5 can be penetrated therethrough.

A mirror mounting portion 4*b* protruded as a ring shape is formed on inside of the outlet portion 4*a* of the waveguide so that the dielectric mirror 10 can be adhered and fixed thereon.

At that time, it is desirable that the mirror mounting portion 4*b* is installed as close to an end of the outlet portion 4*a* of the waveguide 4 as possible, so that a protruded height of the outlet portion 4*b* between the dielectric mirror 10 and the reflector 7 can be minimized.

In addition, the bulb 5 is disposed so that a center of an emitting portion 5*a* is located on a focal point of a parabola formed by the reflector 7 and by the dielectric mirror 7.

Therefore, the dielectric 10 is fixed by adhering or caulking in a state of mounting on a mirror mounting portion 4*b* formed on an end of the outlet portion 4*a* of the waveguide 4, and makes a parabola structure with the reflector 7 to reflect the light generated in the bulb 5 to be parallel.

On the other hand, the dielectric mirror 10 may be formed as non-curvature shape if an angle of the reflected light is parallel for the incident angle of the light forward.

That is, the dielectric mirror 10 is not formed as curved surface shape as shown in FIGS. 3 and 4, but formed as a plane in which the light radiated from the bulb 5 can be radiated forward by being reflected parallelly to the incidence angle.

Unexplained reference numeral 9*a* represents a fan housing, 9*b* represents a blast fan, M1 represents a bulb motor, and M2 represents a fan motor.

Operation and effect of the lighting apparatus using microwave according to the present invention will be described as follows.

When the high voltage which is raised in the high voltage generator is supplied to the magnetron 2, the magnetron 2 generates microwave. And the microwave is radiated into the mesh screen 6 through the waveguide 4 to discharge the material filled in the emitting portion 5*a* of the bulb 5, and thereby the light is emitted.

In addition, some of the light generated in the bulb 5 is reflected forward by the reflector 7 and by the dielectric mirror 10 so as to light an area.

At that time, some of the light generated in the bulb 5 is radiated parallelly forward by being reflected on the reflector 7, and the light which is radiated to rear direction of the bulb 5 is reflected on the dielectric mirror 10 of parabola shape and radiated forward as shown in FIG. 4.

Also, the reflector 7 and the dielectric mirror 10 form a parabola, and accordingly, the center of the emitting portion 5*a* in the bulb 5 is located on the focal point of the above parabola. Then, most of the light generated in the emitting portion 5*a* of the bulb 5 is changed to parallel ray when the light is reflected on the reflector 7 and the dielectric mirror 10 and radiated, and therefore, the lightness of the lighting system is higher than that of the conventional art in same input condition. And therefore, power consumption of the entire lighting system can be lowered effectively.

Therefore, according to the lighting apparatus using the microwave of the present invention, the reflector and the dielectric mirror are constructed so that the light generated in the bulb is all radiated as parallel ray, and therefore the lighting efficiency can be improved. In addition, the bulb can be disposed on the focal point of the reflector easily, and therefore, positioning and installing operations of the bulb can be performed easily.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A lighting apparatus using microwave energy comprising:

a waveguide for transmitting microwave energy generated in a magnetron;

a mesh screen coupled to an outlet portion of the waveguide for blocking leakage of the microwave energy and passing light;

a bulb positioned inside the mesh screen for emitting light by the microwave energy;

a dielectric mirror installed on the outlet portion of the waveguide for passing the microwave energy and reflecting the light emitted in the bulb forward; and a reflector positioned around the mesh screen for reflecting the light emitted in the bulb.

2. The apparatus of claim 1, wherein the dielectric mirror is formed to have same curvature as that of the reflector.

3. The apparatus of claim 2, wherein the bulb is disposed on a focal point of a parabola formed by the dielectric mirror and the reflector.

4. The apparatus of claim 1, wherein a bulb shaft connected to the bulb is passed through the outlet portion of the waveguide, and the dielectric mirror includes a hole so that the bulb shaft can be passed therethrough.

5. The apparatus of claim 1, wherein a mirror mounting portion which is protruded inward is formed on the outlet portion of the waveguide so that the dielectric mirror can be installed thereon.

6. The apparatus of claim 5, wherein the mirror mounting portion is installed on an end of the outlet portion of the waveguide.

7. A microwave powered lighting apparatus comprising:

an electrodeless plasma bulb;

a waveguide having an inlet to receive microwave energy and an outlet to convey microwave energy to the bulb; and a curved reflector attached to an inner periphery of the waveguide outlet to reflect light emitted from the bulb.

8. The apparatus of claim 7, further comprising a curved reflector mounting portion located on inner surfaces of the waveguide outlet to allow the curved reflector to be attached thereto.

9. The apparatus of claim 7, further comprising a microwave energy source to provide microwave energy to the bulb via the waveguide.

10. The apparatus of claim 7, further comprising a parabolic reflector attached to an outer periphery of the waveguide outlet.

11. The apparatus of claim 10, wherein the curved reflector and the parabolic reflector have a curvature such that the bulb is located at a focal point of the reflectors.

12. The apparatus of claim 7, further comprising a mesh screen insertingly fitted onto an outer periphery of the waveguide outlet.

13. A microwave powered illumination device comprising:

a discharge element;

a waveguide having an outlet to direct microwave energy to the discharge element; and a curved reflector attached to an inner periphery of the waveguide outlet to reflect light emitted from the discharge element upon microwave energy being provided thereto.

14. The device of claim 13, wherein the discharge element contains a material that is excitable by microwave energy to emit light therefrom.

15. The device of claim 13, further comprising a curved reflector mounting portion located on inner surfaces of the waveguide outlet to allow the curved reflector to be attached thereto.

16. The device of claim 13, further comprising a microwave energy source to provide microwave energy to the discharge element via the waveguide.

17. The device of claim 13, further comprising a parabolic reflector attached to an outer periphery of the waveguide outlet.

18. The device of claim 17, wherein the curved reflector and the parabolic reflector have a curvature such that the discharge element is located at a focal point of the reflectors.

19. The device of claim 13, further comprising a mesh screen insertingly fitted onto an outer periphery of the waveguide outlet.

20. The device of claim 19, further comprising a parabolic reflector insertingly fitted onto an outer periphery of the waveguide outlet with a portion of the mesh screen located between the waveguide outlet and the parabolic reflector.

* * * * *